US008662691B2

(12) United States Patent
Harada

(10) Patent No.: US 8,662,691 B2
(45) Date of Patent: Mar. 4, 2014

(54) LIGHT-EMITTING DEVICE

(75) Inventor: Mitsunori Harada, Tokyo (JP)

(73) Assignee: Stanley Electric Co., Ltd., Tokyo (JP)

( * ) Notice: Subject to any disclaimer, the term of this patent is extended or adjusted under 35 U.S.C. 154(b) by 150 days.

(21) Appl. No.: 13/424,294

(22) Filed: Mar. 19, 2012

(65) Prior Publication Data

US 2012/0236536 A1 Sep. 20, 2012

(30) Foreign Application Priority Data

Mar. 18, 2011 (JP) ..... 2011-060129

(51) Int. Cl.
*F21V 9/16* (2006.01)

(52) U.S. Cl.
USPC ..... 362/84; 362/553; 362/235

(58) Field of Classification Search
USPC ..... 362/84, 553, 240
See application file for complete search history.

(56) References Cited

U.S. PATENT DOCUMENTS

2011/0249242 A1* 10/2011 Saitou et al. ..... 353/98
2013/0038847 A1* 2/2013 Katou ..... 353/98

FOREIGN PATENT DOCUMENTS

JP 2004-354495 A 12/2004
JP 2005-537651 A 12/2005
JP 2010-232044 A 10/2010
WO 2004/021461 A2 3/2004

* cited by examiner

*Primary Examiner* — Evan Dzierzynski
(74) *Attorney, Agent, or Firm* — Kenealy Vaidya LLP

(57) ABSTRACT

A light-emitting device can include a fluorescent plate having a first surface and a second surface opposite to the first surface and configured to emit fluorescent light by laser irradiation. A first laser light source can be disposed such that the first surface of the fluorescent plate is irradiated with first laser light. A second laser light source can be disposed such that the second surface of the fluorescent plate is irradiated with second laser light. A reflector can include a light passing hole through which the second laser light can pass and can include a concave reflecting surface configured to cover an irradiation region with the second laser light at least on the fluorescent plate. A lens can be disposed in a space closer to the first surface of the fluorescent plate.

21 Claims, 2 Drawing Sheets

Fig. 1
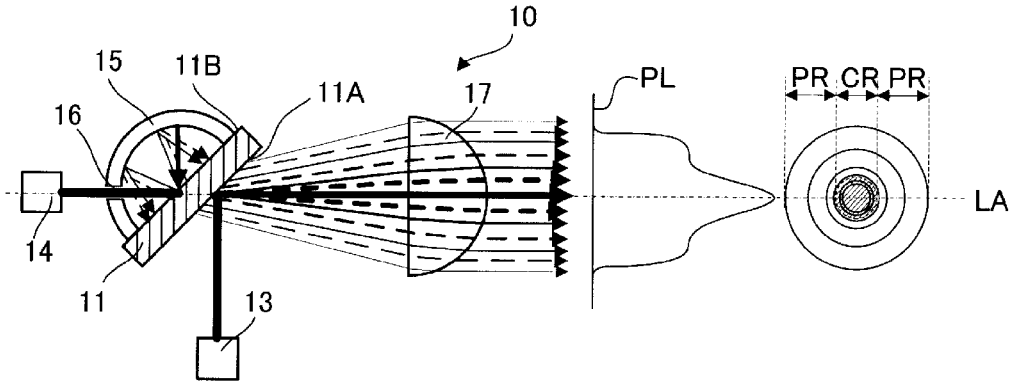
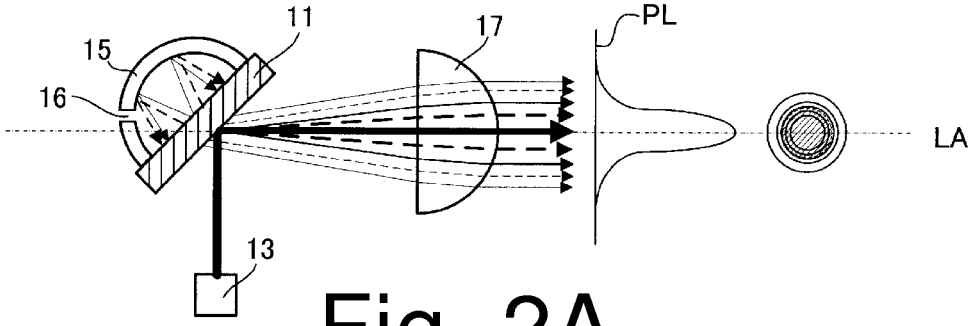
Fig. 2A
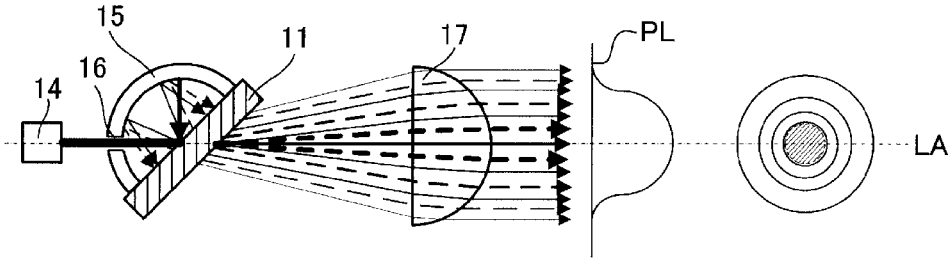
Fig. 2B

LIGHT-EMITTING DEVICE

This application claims the priority benefit under 35 U.S.C. §119 of Japanese Patent Application No. 2011-060129 filed on Mar. 18, 2011, which is hereby incorporated in its entirety by reference.

TECHNICAL FIELD

The presently disclosed subject matter relates to a light-emitting device, and in particular, to a light-emitting device for use in a vehicle headlamp utilizing a semiconductor laser diode element.

BACKGROUND ART

Recent light-emitting devices utilizing a semiconductor laser diode (LD) element can provide white light by using a wavelength conversion material such as a fluorescent material that can be excited by, for example, blue light emitted from the LED element to emit yellow light. Specifically, white light can be obtained by mixing the yellow fluorescent light generated from the fluorescent material due to excitation with the blue excitation light originally emitted from the LD element. Favorable white light can be produced by efficiently exciting the fluorescent material with the blue excitation light, and then balancing the blue excitation light and the yellow fluorescent light.

Light-emitting devices for use in a vehicle headlamp should provide light distribution characteristics having both favorable white light characteristics and securement of far distance visibility and wide front irradiation region. The far distance visibility can be achieved by the light distribution property having a large central peak in the light irradiation plane (at the so-called cut-off area). The wider front irradiation region can be achieved by the light distribution property with the light distribution gently lowering from the central region in the light irradiation plane to the periphery.

Japanese Patent Application Laid-Open No. 2004-354495 discloses a light source device including a fluorescent material emitting fluorescent light by excitation light, a concave mirror configured to reflect the light from the fluorescent material, and an LED element or an LD element configured to emit the excitation light.

Japanese Patent Application Laid-Open No. 2010-232044 discloses a vehicle lighting unit including a light-emitting unit that includes an LED light source configured to form a low beam light distribution pattern and a fluorescent material for the LED light source. The fluorescent material configured to emit light upon receipt of the light from the LED light source to (or in the vicinity of) a cut-off area in the light distribution pattern.

Japanese Translation of PCT Patent Application No. 2005-537651 discloses a light-emitting semiconductor, a semi-spherical transparent lens configured to cover the light-emitting semiconductor, and a fluorescent material layer disposed on or near the surface of the transparent lens, so that the fluorescent material layer is excited by the light from the light-emitting semiconductor to provide fluorescent light.

In the light source device (or light-emitting device) as shown in Japanese Patent Application Laid-Open No. 2004-354495, a large amount of light emitted from the LED element may not be involved in the excitation of the fluorescent material but reflected off the surface of the fluorescent material. Therefore, the amount of reflected excitation light may be more than the amount of the fluorescent light emitted from the fluorescent material, so that it becomes difficult to obtain appropriate white light by adjusting the mixing ratio of the reflected excitation light and the fluorescent light.

In the vehicle lighting unit (or light-emitting device) as shown in Japanese Patent Application Laid-Open No. 2010-232044, the excitation light emitted from the LED light source can excite the fluorescent material, but a large amount of the excitation light cannot excite the fluorescent material and is instead reflected on the surface of the fluorescent material. Therefore, because of the same reason as in the light source device of Japanese Patent Application Laid-Open No. 2004-354495, it becomes difficult to obtain appropriate white light by mixing the reflected excitation light and the fluorescent light.

In the light-emitting semiconductor (or light-emitting device) as shown in Japanese Translation of PCT Patent Application No. 2005-537651, when the excitation light is incident on the fluorescent material layer, the light may be reflected off the rear surface, whereby the light emission efficiency may deteriorate. Further, the fluorescent light component emitted from the fluorescent material may be dispersed in various directions, whereby it becomes difficult to form a light distribution pattern having a large central illuminance peak in the irradiation region and being suitable for use in a vehicle headlamp in particular.

In addition, in the light-emitting device as shown in Japanese Patent Application Laid-Open No. 2004-354495 and Japanese Translation of PCT Patent Application No. 2005-537651, light with a fixed light distribution pattern may only be obtained, and therefore, it is difficult to control the light distribution pattern as desired.

SUMMARY

The presently disclosed subject matter was devised in view of these and other problems and features and in association with the conventional art. According to an aspect of the presently disclosed subject matter, a light-emitting device can provide an improved light extraction efficiency and an excitation efficiency of a fluorescent plate and can control emission color and the light distribution with ease.

According to another aspect of the presently disclosed subject matter, the light-emitting device can include a fluorescent plate having a first surface and a second surface opposite to the first surface and configured to emit fluorescent light by laser irradiation; a first laser light source disposed such that the first surface of the fluorescent plate can be irradiated with first laser light; a second laser light source disposed such that the second surface of the fluorescent plate can be irradiated with second laser light; a reflector having a light passing hole through which the second laser light can pass and a concave reflecting surface configured to cover an irradiation region with the second laser light at least on the fluorescent plate; and a lens disposed in a space closer to the first surface of the fluorescent plate, the lens configured to collect reflected light of the first laser light off the surface of the fluorescent plate and fluorescent light emitted from the fluorescent plate excited by the first laser light and the second laser light.

In the light-emitting device with the above configuration, the concave reflecting surface of the reflector can have a curved shape.

In the light-emitting device with the above configuration, a concave portion can be formed in the first surface of the fluorescent plate where the first laser light can impinge thereon.

In the light-emitting device with the above configuration, the first laser light can be multiply-reflected within the concave portion.

In the light-emitting device with the above configuration, the fluorescent plate can be a sintered body of fluorescent material powder that can be excited by the first laser light and the second laser light and emit yellow fluorescent light.

The light-emitting device with the above configuration can further include a regulator that can adjust at least one light intensity of the first and second laser light.

In the light-emitting device with the above configuration, the concave reflecting surface of the reflector can cover an emission region of the fluorescent plate that can emit light to be collected by the lens.

In the light-emitting device with the above configuration, the first laser light regularly reflected off the fluorescent plate and the second laser light entering the fluorescent plate can be positioned on the same optical axis.

In the light-emitting device with the above configuration, the concave reflection surface of the reflector can be configured to reflect the second laser light, which is reflected off the fluorescent plate, to the irradiation region of the fluorescent plate which is to be irradiated with the second laser light.

In the light-emitting device with the above configuration, the concave reflection surface of the reflector can at least partly include a diffused and reflected surface.

According to a light-emitting device made in accordance with principles of the presently disclosed subject matter, the front surface and the rear surface of the fluorescent plate can be disposed in the light irradiation direction and the opposite direction, respectively, and can be irradiated with laser light. The reflector can cover the laser irradiation region of the rear surface of the fluorescent plate so that the light reflected off the rear surface can be redirected back to the fluorescent plate. Accordingly, the fluorescent material excitation efficiency can be improved and the color mixture of the excitation light and the fluorescent light and the control of the light distribution can be facilitated. In particular, it is possible to achieve a favorable light distribution pattern suitable for use in a vehicle headlight in which the intensity of illumination is very strong at the central region in the light irradiation plane while being lowered toward the periphery. Further, it is possible to provide a light-emitting device with a high light emission efficiency, superior emission color and the controllability of light distribution.

BRIEF DESCRIPTION OF DRAWINGS

These and other characteristics, features, and advantages of the presently disclosed subject matter will become clear from the following description with reference to the accompanying drawings, wherein:

FIG. 1 is a diagram illustrating a light-emitting device of an exemplary embodiment made in accordance with principles of the presently disclosed subject matter;

FIGS. 2A and 2B are diagrams each showing light paths from respective LE elements of the exemplary embodiment of FIG. 1;

DESCRIPTION OF EXEMPLARY EMBODIMENTS

Figure 3:
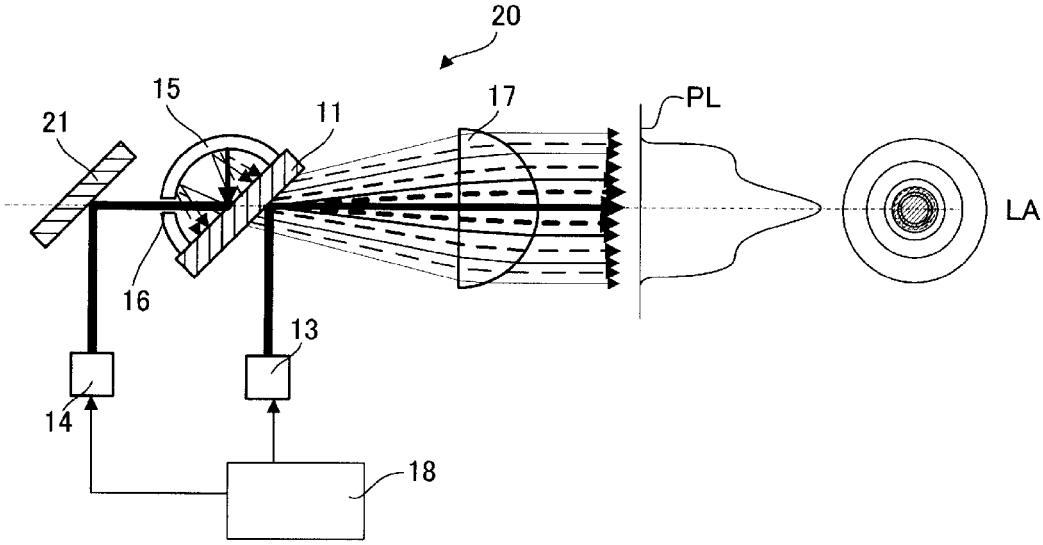
FIG. 3 is a diagram illustrating a light-emitting device of another exemplary embodiment made in accordance with principles of the presently disclosed subject matter.

A description will now be made below to light-emitting devices of the presently disclosed subject matter with reference to the accompanying drawings in accordance with exemplary embodiments.

In the associated drawings, the substantially same or equivalent components and parts may be denoted by the same reference numerals.

FIG. 1 is a cross-sectional view illustrating a light-emitting device 10 of a first exemplary embodiment made in accordance with principles of the presently disclosed subject matter when taken along a plane perpendicular to the light irradiation plane PL. Light paths within the light-emitting device 10 are shown in FIG. 1, and the excitation light component is shown by a solid line while the fluorescent light component is shown by a dashed line. The thickness of the line schematically represents the light intensity. The optical axis of the light-emitting device 10 is represented by LA. In the drawings, on the right side of the cross-sectional view, a light distribution in the light irradiation plane PL is shown together with the curve of the intensity of illumination. Specifically, the curve of the intensity of illumination can show the distribution of the intensity of illumination on the irradiation plane to be irradiated with the light emitted from the light-emitting device 10 (or the light irradiation plane PL). In the drawings, the light irradiation plane PL is represented as a line because the object is observed from the lateral side of the plane. The hatched area in the light distribution shows the central region where a high intensity of illumination should be desired in a vehicle headlamp (namely, corresponding to the cut-off area (CR)). The peripheral region near the central region is represented by PR.

As shown in FIG. 1, the light-emitting device 10 can include a fluorescent plate 11, a first semiconductor laser diode element 13 (hereinafter, LD element 13), a second semiconductor laser diode element 14 (hereinafter, LD element 14), a reflector 15, and a lens 17.

The fluorescent plate 11 can have a square planar shape with one side of approximately seven (7) mm to about (20) mm, and can be disposed with respect to the light irradiation plane PL by about 45 degrees. Further, the fluorescent plate 11 can be disposed with respect to the light emission surface of the LED element 13 by about 45 degrees such that the light emitted from the LED element 13 can be incident on the fluorescent plate 11 by about 45 degrees. The fluorescent plate 11 can be a sintered body of fluorescent material powder having a light-transmitting property and produced by sintering, for example, compacted YAG powder (yttrium aluminum garnet: $Y_3Al_5O_{13}$). The fluorescent material used herein can absorb, for example, blue excitation light with a wavelength of about 460 nm emitted from the LD elements 13 and 14 and be excited by the same, so as to emit yellow fluorescent light having an emission peak wavelength of about 560 nm. Accordingly, the blue excitation light emitted by the LD element and not absorbed by the fluorescent material and reflected by the same can be mixed with the yellow fluorescent light generated by the fluorescent material, thereby producing white light (pseudo-white light).

The fluorescent plate 11 may include a light-transmitting material, such as a silicone resin, an epoxy resin, a urethane resin or a hybrid resin containing an epoxy resin and a silicone resin. In this case, the fluorescent material such as YAG:Ce fluorescent material (that is formed of YAG together with Ce as an activator agent) can be dispersed in the resin for the fluorescent plate 11. The fluorescent plate 11 may be a light-transmitting glass doped with a fluorescent material. The fluorescent material can be selected corresponding to the wavelength of excitation light from the light source (laser diode), and examples thereof may include red fluorescent materials, green fluorescent materials, and blue fluorescent materials when the excitation light is ultraviolet light, and red fluorescent materials and green fluorescent materials when the excitation light is blue light in addition to the above YAG fluorescent material.

The first LD element 13 can be a laser diode configured to emit blue excitation light with a wavelength of about 430 nm to 470 nm, for example. The first LD device 13 can be disposed within a space closer to the front surface 11A of the fluorescent plate 11. Then, during operation, the laser light (first laser light) from the first LD element 13 can be emitted toward the front surface 11A of the fluorescent plate 11. The first LD element 13 can be disposed such that part of the emitted laser light can be reflected off the front surface 11A of the fluorescent plate 11 and regularly reflected light can travel along the optical axis LA perpendicular to the light irradiation plane PL and reach the light irradiation plane PL.

The second LD element 14 can be disposed in a space closer to the rear surface 11*b* opposite to the front surface 11A of the fluorescent plate 11. The second LD element 14 can emit second laser light toward the rear surface 11B of the fluorescent plate 11. The second laser light can be projected onto a crossing point between the rear surface 11B of the fluorescent plate 11 and an extension of the optical axis LA. If the laser light passing through the fluorescent plate 11 is used as irradiation light, the second LD element 14 can be configured such that the second laser light having passed through the fluorescent plate 11 can travel along the optical axis LA.

The reflector 15 can be a member formed from a silicone resin, an epoxy resin and the like resin or glass, and have a hollow semispherical shape with a concave reflecting surface (inner wall). The concave reflecting surface of the reflector 15 can cover the fluorescent plate 11 from the rear surface 11B side such that it surrounds at least the irradiation region by the second laser light of the fluorescent plate 11. The irradiation region by the second laser light of the fluorescent plate 11 and the reflector 15 can be separated at a distance. The reflector 15 can be secured to the fluorescent plate 11 by a silicone adhesive or the like. The reflector 15 can have a light passing hole 16 by a laser processing or the like so that the second laser light can pass therethrough.

The concave reflecting surface of the reflector 15 can be a semispherical shape of which center is at or near (i.e., substantially at) the area of the rear surface 11B of the fluorescent plate 11 that is irradiated with the second laser light emitted from the second LD element 14, and can be subjected to silver deposition or aluminum deposition to be formed into a mirror-finished reflecting surface. Accordingly, the light component of the second laser light reflected off the rear surface 11B of the fluorescent plate 11 can be reflected by the concave reflecting surface of the reflector 15 to be redirected to the rear surface 11B of the fluorescent plate 11. The reflector 15 can also function to redirect the fluorescent light forward, the fluorescent light being generated by the fluorescent material excited by the first and second laser light and emitted rearward with respect to the fluorescent plate 11. In order to prevent light leakage other than the light irradiation direction, the area of the opening portion of the reflector 15 should be smaller than the area of the planar area of the fluorescent plate 11. Further, the light passing hole 16 should be larger than the beam diameter of the second laser light in order to allow the second laser light to pass therethrough while it should also be as small as possible in order to prevent leakage from the fluorescent plate 11, light reflected off the fluorescent plate 11 and the light emitted by the fluorescent plate 11.

The concave portion forming the concave reflecting surface is not necessarily hollow, but can be filled with a light transmitting material such as a light transmitting resin. With this configuration, the mechanical strength of the reflector 15 can be enhanced.

The lens 17 can be a convex lens formed from an optical glass, polycarbonate resins, silicone resins, or a light transmitting material. The lens 17 can be disposed in front of the fluorescent plate 11 so that the lens 17 can collect excitation light reflected off the fluorescent plate 11 and fluorescent light emitted from the fluorescent plate 11. Specifically, the incident position of the first laser light on the fluorescent plate 11 can be positioned at or near (i.e., substantially at) the focal point of the lens 17, so that the light incident on the lens 17 can be collected while being collimated along the optical axis LA. Note that, as shown in FIG. 1 and the following FIGS. 2 to 4, the other members including the fluorescent plate, reflector, laser light source, and the like are illustrated in an enlarged state as compared with the lens, and they are not illustrated in an actual proportion.

When the light-emitting device 10 is used in a vehicle headlamp, a light-shielding member (not shown) configured to form a desired cut-off line can be appropriately disposed between the lens 17 and the fluorescent plate 11.

Herein, with reference to FIGS. 2A and 2B, a description will be given of the light paths of laser light from the LD elements 13 and 14 in the light-emitting device 10. As in FIG. 1, in FIG. 2 the excitation light component is shown by a solid line while the fluorescent light component is shown by a dashed line, and the thickness of the line schematically represents the light intensity. Further, as in FIG. 1, on the right side of the cross-sectional view, a light distribution is shown together with the curve of the intensity of illumination.

FIG. 2A is a diagram showing the light paths of the first laser light emitted from the first LD element 13, the curve of the intensity of illumination, and a light distribution. Part of the first laser light can be regularly reflected or diffusedly reflected off the front surface 11A of the fluorescent plate 11 to be directed to the lens 17. The remaining part of the first laser light can excite the fluorescent material in the fluorescent plate 11 or pass through the fluorescent plate 11 without excitation of the fluorescent material and reach the reflector 15. The light having passed through the fluorescent plate 11 without excitation of the fluorescent material can be reflected by the reflector 15 to be again incident on the fluorescent plate 11 so as to excite the fluorescent material. Part of the fluorescent light emitted by the fluorescent plate 11 by the excitation of the first laser light can be emitted forward to travel to the lens 17. The light emitted toward the reflector 15 can be reflected by the reflector 15 to be redirected to the lens 17 through the fluorescent plate 11. The reflected excitation light and fluorescent light entering the lens 17 can be collected so as to form a desired light distribution and extracted from the light-emitting device 10.

As seen from the curve of the intensity of illumination and the light distribution of FIG. 2A, the first laser light can form the light distribution in which the light component of the first laser light regularly reflected off the front surface 11A of the fluorescent plate 11 is relatively large in amount, so that a peak can be formed in the central region CR in the irradiation plane PL. However, the first laser light can be introduced into the fluorescent plate 11 only in a relatively small amount, so that the fluorescent light emitted from the fluorescent material is small in amount. Further, since the excitation light diffused and reflected off the front surface 11A of the fluorescent plate 11 is relatively small in amount, it can be seen that the light can be irradiated only in a small amount in the peripheral region PR around the central region CR. This means that the first laser light of the first LD element 13 can ensure the far distance visibility. Note that, since the first laser light includes a relatively large amount of light components regularly reflected off the front surface 11A of the fluorescent plate 11, the color of light in the central region CR in the configuration of FIG. 2A can be strongly bluish white.

FIG. 2B is a diagram showing the light paths of the second laser light emitted from the second LD element 14, the curve of the intensity of illumination, and a light distribution. Part of the second laser light can excite the fluorescent material in the fluorescent plate 11, and the remaining part thereof can pass through the fluorescent plate 11 without excitation of the fluorescent material or can be reflected off the rear surface 11B of the fluorescent plate 11. The light having passed through the fluorescent plate 11 can be diffused in part and be directed to the lens 17 in part. The second laser light reflected off the rear surface 11B of the fluorescent plate 11 can be reflected by the reflector 15 to be incident on the fluorescent plate 11 again and excite the fluorescent material. Part of the fluorescent light emitted by the fluorescent plate 11 by the excitation of the second laser light can be emitted forward to travel to the lens 17 while the light emitted toward the reflector 15 can be reflected by the reflector 15 to be redirected to the lens 17 through the fluorescent plate 11. The reflected excitation light and fluorescent light entering the lens 17 can be collected so as to form a desired light distribution and be projected from the light-emitting device 10.

As seen from the curve of the intensity of illumination and the light distribution of FIG. 2B, the second laser light can form the light distribution with a central peak. However, the light distribution can include the wider peripheral region PR different from that formed by the first laser light. This is because the second laser light can be guided in an in-plane direction of the fluorescent plate 11 within the plate 11, whereby the fluorescent plate 11 can be excited in a wider region to emit fluorescent light from that wider region while part of the light component passing through the fluorescent plate 11 without excitation of the fluorescent material can be diffused to be directed to the lens 17. In addition, the excitation light diffused and reflected in the rear of the fluorescent plate 11 and redirected to the fluorescent plate 11 can excite the fluorescent material in the entire region of the fluorescent plate 11 covering the reflector 15, thereby ensuring the light distributed in the peripheral region PR. In this manner, the second laser light can ensure the wider front irradiation region. Note that, since the second laser light includes a relatively small amount of light components passing through the fluorescent plate 11 without excitation of the fluorescent material, the color of light in the central region CR in the configuration of FIG. 2B can be strongly yellowish white.

Here, with reference to FIG. 1, the light distribution formed by the light-emitting device 10 can be composed of the light distribution by the LD element 13 as shown in FIG. 2A and the light distribution by the LD element 14 as shown in FIG. 2B. Namely, the light distribution formed by the light-emitting device 10 may include a central large peak and a gradually widened peripheral region PR. Specifically, in the light distribution formed by the light emitting device 10, the intensity of illumination can be high at the central region CR in the light irradiation plane (at or near the cut-off line), meaning that the high far distance visibility is achieved. In addition, the intensity of illumination can gently decrease toward the periphery of the light irradiation plane, meaning that the wider front irradiation region can be ensured so that the favorable light distribution characteristics for a vehicle headlamp or the like can be formed therefrom. Since the strongly bluish white light generated by the first laser light and the strongly yellowish white light generated by the second laser light can be mixed together at the central region CR in the light irradiation plane, white light with uniform color over the wider range including the central region CR and the peripheral region PR can be obtained in the light distribution formed by the light-emitting device 10 (generated by the first laser light and the second laser light).

The light-emitting device 10 can be configured to adjust the color of the illumination light and the light distribution as appropriate. The method of controlling the mixture of the blue excitation light and the yellow fluorescent light in the light-emitting device 10, namely, the method of adjusting the color of the illumination light can be achieved in the following manner.

A first exemplary method of adjusting the color of the illumination light is to change the thickness of the fluorescent plate 11 and/or the concentration of the fluorescent material in the fluorescent plate 11. Specifically, the thickening of the fluorescent plate 11 and/or increasing of the fluorescent concentration can adjust the color of the illumination light closer to yellow because the yellowish light emitted by the excitation of the fluorescent material by the second laser light from the second LD element 14 can be increased. Further, the thinning of the fluorescent plate 11 and/or decreasing of the fluorescent concentration can adjust the color of the illumination light closer to blue.

A second exemplary method of adjusting the color of the illumination light is to change the intensity of the first and/or second laser light to be irradiated onto the fluorescent plate 11. Specifically, the increasing of the intensity of the first laser light can adjust the color of the illumination light closer to blue because the proportion of the blue excitation light to be reflected off the fluorescent plate 11 can be increased. On the contrary, the increasing of the intensity of the second laser light can adjust the color of the illumination light closer to yellow because the proportion of the yellow fluorescent light to be emitted from the fluorescent plate 11 can be increased. The adjustment of the intensity of light may be achieved by varying the drive current to the first LD element 13 and the second LD element 14 using a regulator 18 as shown in FIG. 3, for example. Alternatively, a filter or a light intensity regulation member that can change its light transmittance may be disposed on light paths of the laser light emitted by the LD elements 13 and 14.

A third exemplary method of adjusting the color of the illumination light is to change the surface roughness of the fluorescent plate 11. Specifically, the increasing of the surface roughness of the front surface 11A of the fluorescent plate 11 can facilitate the introduction of the first laser light emitted from the first LD element 13 into the fluorescent plate 11. With this configuration, the excitation light of the first laser light reflected off the surface of the fluorescent plate 11 can be decreased in a particular amount. On the other hand, the excitation light that can excite the fluorescent material after being introduced into the fluorescent plate 11 can be increased in an amount, meaning that the fluorescent light emitted from the fluorescent plate 11 can be increased. In this manner, the color of the illumination light of the light-emitting device 10 can be adjusted close to yellow. In the same manner, the decreasing of the surface roughness of the front surface of the fluorescent plate 11 (for example, providing a more mirror-finished surface) can adjust the color of the illumination light of the light-emitting device 10 closer to blue.

The method of adjusting the light distribution in the light-emitting device 10 can be achieved in the following manner.

A first exemplary method of adjusting the light distribution is to change the light output of the first LD element 13 and/or the second LD element 14 as in the above second exemplary method of adjusting the color of the illumination light. Specifically, the increasing of the intensity of the first laser light can increase the excitation light component reflected off the surface of the fluorescent plate 11, thereby increasing the intensity of illumination at the central region CR (near the cut-off line) in the light irradiation plane. This can adjust the light distribution pattern with improved far distance visibility. On the other hand, the increasing of the intensity of the second laser light can excite the fluorescent material in the fluorescent plate 11 more, thereby increasing the amount of the fluorescent light emitted by the fluorescent plate 11. This can adjust the light distribution pattern with improved intensity of illumination at the peripheral region PR in the light irradiation plane. The adjustment of the intensity of laser light can be achieved by the same method as in the above second exemplary method of adjusting the color of illumination light.

A second exemplary method of adjusting the light distribution is to change the position on the fluorescent plate 11 where the laser light is irradiated. Specifically, the positions of the first laser light emitted from the first LD element 13 and the second laser light emitted from the second LD element 14 can be relatively moved on the fluorescent plate 11. The peak region irradiated with the first laser on the light irradiation plane PL can thereby be moved within the entire irradiation region relatively.

A third exemplary method of adjusting the light distribution is to change the shape of the reflector 15. Specifically, if a horizontally long light distribution should be formed in the light irradiation plane PL, the shape of the concave reflecting surface of the reflector 15 may be an elliptic semispherical shape having a long diameter in the horizontal direction when the reflector is seen from the light irradiation plane PL. Alternatively, part of the reflecting surface of the reflector 15 can be formed to achieve diffuse reflection where the excitation light is reflected off the rear surface 11B of the fluorescent plate 11, thereby diffusing the excitation light. This diffused excitation light can be incident on the entire surface of the fluorescent plate 11. Accordingly, the intensity of illumination is increased at the peripheral region PR in the light irradiation plane. In this case, the rear surface 11B of the fluorescent plate 11 may be subjected to mirror-finishing. This can increase the excitation light component to be reflected off the surface of the fluorescent plate 11. More excitation light can be diffused by the reflecting surface of the reflector 15, thereby increasing the intensity of the illumination at the peripheral region PR. Note that the concave reflecting surface of the reflector 15 can have a curved shape such as a semispherical shape, but in accordance with the desired light distribution pattern, may have a multi-reflector shape, a conical shape, a pyramid shape, and the like.

A fourth exemplary method of adjusting the light distribution is to change the shape of the lens 17. Specifically, if a horizontally long light distribution should be formed in the light irradiation plane PL, a planar lens that can cause the light to be collimated in the vertical direction and to be diffused in the horizontal direction may be used.

Next, a light-emitting device 20 of a second exemplary embodiment made in accordance with the principles of the presently disclosed subject matter will be described with reference to FIG. 3. FIG. 3 is a cross-sectional view illustrating the light-emitting device 20 of the second exemplary embodiment when taken along a plane perpendicular to the light irradiation plane PL.

The light-emitting device 20 can be configured in the same manner as in the first exemplary embodiment except that a reflection mirror 21 is provided and the first LD element 13 and the second LD element 14 are disposed in close proximity to each other.

Specifically, in the light-emitting device 20 of the second exemplary embodiment, the first LD element 13 and the second LD element 14 are juxtaposed with each other so that the first laser light from the first LD element 13 and the second laser light from the second LD element 14 travel parallel to each other.

The reflection mirror 21 can be inclined by 45 degrees with respect to the light irradiation plane PL so that the second laser light emitted from the second LD element 14 can pass through the light passing hole 16 of the reflector 15. The reflection mirror 21 can be formed from a silicone resin, an epoxy resin and the like resin, or glass. The reflection mirror 21 can have a laser light reflection surface that can be subjected to silver deposition or aluminum deposition.

In the light-emitting device 20, the second laser light emitted from the second LD element 14 can be reflected by the reflection mirror 21, and then, as in the first exemplary embodiment, can pass through the light passing hole 16 and reach the fluorescent plate 11. Then, the light can follow the same optical paths as in the first exemplary embodiment.

Since the light-emitting device 20 of the second exemplary embodiment can utilize the reflection mirror 21, the first LD element 13 and the second LD element 14 can be juxtaposed with each other in a manner unlike in the light-emitting device 10. This configuration can miniaturize the entire device scale of the light-emitting device 20. The first LD element 13 and the second LD element 14 can be mounted on the same substrate with a common heat dissipation mean, thereby simplifying the configuration.

Note that the fluorescent plate 11 can be inclined by an angle other than 45 degrees with respect to the light irradiation plane PL as in the first and second exemplary embodiments. When designing the angle of the fluorescent plate 11 other than 45 degrees, the positions of the first LD element 13 and the second LD element 14 as well as the positions of the reflector 15 and the light passing hole 16 are appropriately changed so that the second laser light can pass the light passing hole 16 and the first laser light can be regularly reflected off the surface of the fluorescent plate 11 so that the regularly reflected light component can reach the light irradiation plane PL while it coincides with the optical axis LA.

Figure 4:
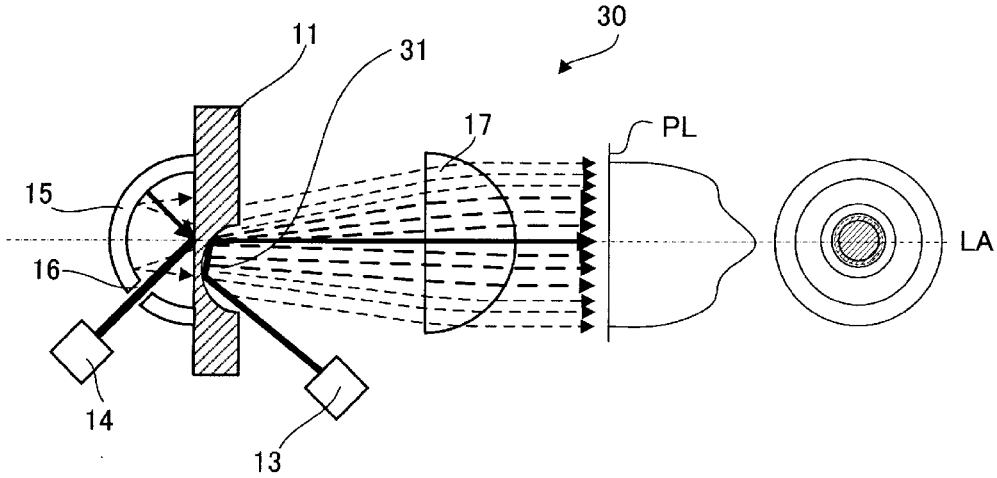
FIG. 4 is a diagram illustrating a light-emitting device of another exemplary embodiment made in accordance with principles of the presently disclosed subject matter.

Next, a light-emitting device 30 of a third exemplary embodiment made in accordance with the principles of the presently disclosed subject matter will be described with reference to FIG. 4. FIG. 4 is a cross-sectional view illustrating the light-emitting device 30 of the third exemplary embodiment when taken along a plane perpendicular to the light irradiation plane PL.

The light-emitting device 30 can be configured in the same manner as in the first exemplary embodiment. In the light-emitting device 30, the fluorescent plate 11 can be disposed in parallel to the light irradiation plane (or, perpendicular to the optical axis of the light emitting device). Furthermore, in order to improve the fluorescent material excitation efficiency by the first laser light from the first LD element 13, a concave portion 31 can be formed in the front surface 11A of the fluorescent plate 11. The first LD element 13 can be inclined by 45 degrees with respect to the fluorescent plate 11 so that the first laser light can impinge on the fluorescent plate 11 by 45 degrees with respect to the plate 11.

The concave portion 31 can have a semispherical shape so that the first laser light entering the concave portion 31 can be multiply-reflected within the concave portion 31 to be directed toward the light irradiation plane PL. As shown, the first laser light from the first LD element 13 can be multiply-reflected within the concave portion 31 of the fluorescent plate 11, thereby efficiently exciting the fluorescent material within the fluorescent plate 11. Accordingly, the fluorescent light emitted from the fluorescent plate 11 can be increased in amount.

In the third exemplary embodiment, the traveling angle of the first laser light with respect to the fluorescent plate 11 can be an angle other than 45 degrees. When designing the arrangement of the first LD element 13, the shape of the concave portion 31 or the angle of the inclined fluorescent plate 11 can be changed so that the excitation light component reflected off the fluorescent plate can travel to the light irradiation plane PL while it coincides with the optical axis LA (namely, along the line perpendicular to the light irradiation plane PL).

In the above exemplary embodiments, the opening portion of the reflector 15 should cover the emission region of the fluorescent plate 11 that can emit light to be collected by the lens 17. With this configuration, the light that cannot impinge on the lens 17 as well as light that cannot reach the light irradiation plane PL can be reduced.

The components described in the above exemplary embodiments can be supported by a single casing (not shown) in order to fix the positional relationship between them.

In the exemplary embodiments as described above, a semiconductor laser diode element is used as the light source, but the presently disclosed subject matter is not limited thereto, and any other laser light sources can be utilized.

In the present exemplary embodiments as described above, the light-emitting device can be used as a vehicle headlamp, but the presently disclosed subject matter is not limited thereto. Namely, the light-emitting device made in accordance with the principles of the presently disclosed subject matter can be used for other illumination devices.

In the above exemplary embodiments, the fluorescent plate 11 can be a parallel planar plate, but the shape of the plate is not limited to this particular shape.

It will be apparent to those skilled in the art that various modifications and variations can be made in the presently disclosed subject matter without departing from the spirit or scope of the presently disclosed subject matter. Thus, it is intended that the presently disclosed subject matter cover the modifications and variations of the presently disclosed subject matter provided they come within the scope of the appended claims and their equivalents. All related art references described above are hereby incorporated in their entirety by reference.

What is claimed is:

1. A light-emitting device comprising:

a fluorescent plate having a first surface and a second surface opposite to the first surface and configured to emit fluorescent light by laser irradiation;

a first laser light source disposed such that the first surface of the fluorescent plate is irradiated with first laser light during operation of the first laser light source;

a second laser light source disposed such that the second surface of the fluorescent plate is irradiated with second laser light during operation of the second laser light source;

a reflector having a light passing hole through which the second laser light passes during operation of the second laser light source, and a concave reflecting surface configured to cover an irradiation region with the second laser light at least on the fluorescent plate; and a lens disposed closer to the first surface than the second surface of the fluorescent plate, the lens configured to collect reflected light of the first laser light off the first surface of the fluorescent plate and fluorescent light emitted from the fluorescent plate excited by the first laser light and the second laser light.

2. The light-emitting device according to claim 1, wherein the concave reflecting surface of the reflector has a curved shape.

3. The light-emitting device according to claim 2, wherein a concave portion is formed in the first surface of the fluorescent plate such that the first laser light impinges on the concave portion during operation of the first laser light source.

4. The light-emitting device according to claim 3, wherein the concave portion is configured such that the first laser light is multiply-reflected within the concave portion.

5. The light-emitting device according to claim 4, wherein the fluorescent plate is a sintered body of fluorescent material powder that is excited by the first laser light and the second laser light during operation of the light-emitting device to emit yellow fluorescent light.

6. The light-emitting device according to claim 3, wherein the fluorescent plate is a sintered body of fluorescent material powder that is excited by the first laser light and the second laser light during operation of the light-emitting device to emit yellow fluorescent light.

7. The light-emitting device according to claim 2, wherein the fluorescent plate is a sintered body of fluorescent material powder that is excited by the first laser light and the second laser light during operation of the light-emitting device to emit yellow fluorescent light.

8. The light-emitting device according to claim 2, including a regulator configured to adjust at least one of light intensity of the first laser light and light intensity of the second laser light.

9. The light-emitting device according to claim 1, wherein a concave portion is formed in the first surface of the fluorescent plate such that the first laser light impinges on the concave portion during operation of the first laser light source.

10. The light-emitting device according to claim 9, wherein the concave portion is configured such that the first laser light is multiply-reflected within the concave portion.

11. The light-emitting device according to claim 10, wherein the fluorescent plate is a sintered body of fluorescent material powder that is excited by the first laser light and the second laser light during operation of the light-emitting device to emit yellow fluorescent light.

12. The light-emitting device according to claim 10, including a regulator configured to adjust at least one of light intensity of the first laser light and light intensity of the second laser light.

13. The light-emitting device according to claim 9, wherein the fluorescent plate is a sintered body of fluorescent material powder that is excited by the first laser light and the second laser light during operation of the light-emitting device to emit yellow fluorescent light.

14. The light-emitting device according to claim 9, including a regulator configured to adjust at least one of light intensity of the first laser light and light intensity of the second laser light.

15. The light-emitting device according to claim 1, wherein the fluorescent plate is a sintered body of fluorescent material powder that is excited by the first laser light and the second laser light during operation of the light-emitting device to emit yellow fluorescent light.

16. The light-emitting device according to claim 15, including a regulator configured to adjust at least one of light intensity of the first laser light and light intensity of the second laser light.

17. The light-emitting device according to claim 1, including a regulator configured to adjust at least one of light intensity of the first laser light and light intensity of the second laser light.

18. The light-emitting device according to claim 1, wherein the concave reflecting surface of the reflector covers an emission region of the fluorescent plate that emits light collected by the lens during operation of the light-emitting device.

19. The light-emitting device according to claim 1, wherein the first laser light regularly reflected off the fluorescent plate and the second laser light entering the fluorescent plate are positioned on the same optical axis.

20. The light-emitting device according to claim 1, wherein the concave reflection surface of the reflector is configured to reflect the second laser light, that is reflected off the fluorescent plate, to the irradiation region of the fluorescent plate which is to be irradiated with the second laser light.

21. The light-emitting device according to claim 1, wherein the concave reflection surface of the reflector partly includes a diffusion surface and a reflection surface.

* * * * *